US010633223B1

(12) United States Patent
Cain et al.

(10) Patent No.: US 10,633,223 B1
(45) Date of Patent: Apr. 28, 2020

(54) ADJUSTABLE SPREADER BAR

(71) Applicant: VERSABAR, INC., Houston, TX (US)

(72) Inventors: Christopher Alan Cain, New Orleans, LA (US); Brian Lloyd Freese, New Orleans, LA (US)

(73) Assignee: VERSABAR, INC., Houston, TX (US)

( * ) Notice: Subject to any disclaimer, the term of this patent is extended or adjusted under 35 U.S.C. 154(b) by 0 days.

(21) Appl. No.: 16/201,304

(22) Filed: Nov. 27, 2018

(51) Int. Cl.
*B66C 1/12* (2006.01)

(52) U.S. Cl.
CPC ..... *B66C 1/12* (2013.01)

(58) Field of Classification Search
CPC ..... B66C 1/10; B66C 1/12; B66C 1/14
USPC ..... 294/74, 81.1, 81.2, 81.55, 81.56
See application file for complete search history.

(56) References Cited

U.S. PATENT DOCUMENTS 3,972,501 A 8/1976 Plough
4,114,765 A * 9/1978 Kojima ..... B66C 1/12 269/46
4,188,168 A 2/1980 Brown et al.
4,248,472 A 2/1981 Brown et al.
4,324,023 A 4/1982 Prete, Jr.
4,352,516 A 10/1982 Gasper
4,397,493 A 8/1983 Khachaturian et al.
4,486,120 A 12/1984 Landry, Jr.
4,538,849 A 9/1985 Khachaturian et al.
4,621,850 A * 11/1986 Wiersema ..... H02K 15/0006 29/762
4,925,080 A 5/1990 Crouse et al.
5,163,726 A 11/1992 Boos et al.
5,343,641 A 9/1994 Gregory
5,716,088 A * 2/1998 Chander ..... B66C 1/12 294/81.1
5,820,184 A * 10/1998 Echenay ..... B66C 1/22 294/81.2
5,863,085 A 1/1999 Khachaturian
6,062,620 A 5/2000 Walker et al.
6,079,760 A 6/2000 Khachaturian
6,113,026 A 9/2000 Pottorff
6,296,288 B1 10/2001 Khachaturian
6,314,594 B1 11/2001 Meoli, Jr. et al.
6,412,649 B1 7/2002 Khachaturian
7,182,292 B2 2/2007 Howard et al.
7,222,903 B2 5/2007 Tardiff
D569,331 S 5/2008 Gassew
(Continued)

*Primary Examiner* — Dean J Kramer
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A spreader bar apparatus provides a bar member having a bar length and first and second bar end portions. A plurality of stops (e.g., transverse bar openings) are spaced between the bar and end portions. A first bar lifting portion or link assembly is movable relative to the bar and into different positions. A second bar lifting portion or link assembly is movable relative to the bar and into different positions. Each bar lifting portion or link assembly has a trunnion sleeve fitted with multiple links. One or more lifting lines are each attachable to the lifting portions such as to an upper link or lower link. Each lifting member includes an upper link, a lower link, and a trunnion sleeve, wherein the trunnion sleeve has a bore that is sized and shaped to receive the bar, wherein the upper and lower links are rotatably mounted to the trunnion sleeve.

19 Claims, 9 Drawing Sheets

(56) References Cited

U.S. PATENT DOCUMENTS

| | | | | |
|---|---|---|---|---|
| 7,399,019 | B2 | 7/2008 | Malmgren et al. | |
| 7,837,413 | B1 | 11/2010 | Kundel, Sr. | |
| 7,967,352 | B2 | 6/2011 | Di Martino | |
| 7,988,214 | B2 | 8/2011 | Grizzle | |
| 8,251,309 | B2 | 8/2012 | Sammito et al. | |
| 8,382,175 | B2 | 2/2013 | DiMartino | |
| D717,251 | S | 11/2014 | Mueller | |
| 8,955,894 | B2 | 2/2015 | Parker | |
| 9,132,993 | B1 | 9/2015 | DiMartino et al. | |
| D748,151 | S | 1/2016 | Benson | |
| 10,053,338 | B1 | 8/2018 | Khachaturian | |
| 2011/0298232 | A1* | 12/2011 | Reger | B66C 1/10 294/81.5 |

* cited by examiner

ADJUSTABLE SPREADER BAR

CROSS-REFERENCE TO RELATED APPLICATIONS

Not Applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to spreader bars, and more particularly to spreader bars with a bar member and movable end portions/fittings on the bar member that connect to slings/grommets, wherein the positions of the end portions or fittings or trunions can be adjusted relative to the bar member thus enabling connection to and lifting of objects or loads of various dimensions or sizes. Even more particularly, the present invention relates to an improved spreader bar apparatus that includes a bar and lifting fittings that are movable along the bar and that can be locked or pinned at a selected locale.

2. General Background of the Invention

Spreader bars are used to lift a heavy object (load or package) with a crane, wherein it is important to remove or reduce any horizontal load component on the object, load, or package. Some spreader bar designs have been patented. Examples of patented spreader bars can be seen in the following table, each listed patent being incorporated herein by reference.

The following U.S. Patents are incorporated herein by reference:

| Pat. No. | Title | Date of Issue MM-DD-YYYY |
|---|---|---|
| 10,053,338 | Adjustable Spreader Bar | Aug. 21, 2018 |
| D748,1515 | Spreader Bar | Jan. 26, 2016 |
| 9,132,993 | Load Spreader Bar Pipe Connecting Sleeve with Offset End Plate | Sep. 15, 2015 |
| 8,955,894 | Adjustable Spreader Bar System | Feb. 17, 2015 |
| D717,251S | Heat Spreader with Fins and Top Bar on a Memory Module | Nov. 11, 2014 |
| 8,382,175 | Load Spreader Bar Pipe Connection Sleeve | Feb. 26, 2013 |
| 8,251,309 | Thrust Force Take-Up Device for An Aircraft Engine Pylon Engine Mounting Structure, Comprising Lateral Link Rods with Integral Spreader Bar Stops | Aug. 28, 2012 |
| 7,988,214 | Cargo Spreader Bar | Aug. 02, 2011 |
| 7,967,352 | Load Spreader Bar End Cap | Jun. 28, 2011 |
| 7,837,413 | Adjustable Trench Box and Spreader Bar | Nov. 23, 2010 |
| 7,399,019 | Automatic Adjustable Spreader Bar | Jul. 15, 2008 |
| D569,331S | Spreader Bar Hardware | May 20, 2008 |
| 7,222,903 | Spreader Bar Apparatus | May 29, 2007 |
| 7,182,292 | Wide Spreader Bar and Lift-Up Seat Spreader Bar for Seat Legs | Feb. 27, 2007 |
| 6,412,649 | Spreader Bar Apparatus | Jul. 02, 2002 |
| 6,314,594 | Spreader Bar for a Hammock | Nov. 13, 2001 |
| 6,296,288 | Spreader Bar Apparatus | Oct. 02, 2001 |

-continued

| Pat. No. | Title | Date of Issue MM-DD-YYYY |
|---|---|---|
| 6,113,026 | Bow Spreader Bar | Sep. 05, 2000 |
| 6,079,760 | Spreader Bar Apparatus | Jun. 27, 2000 |
| 6,062,620 | Spreader Bar | May 16, 2000 |
| 5,863,085 | Spreader Bar Assembly | Jan. 26, 1999 |
| 5,343,641 | Spreader Bar for Strip Mine Rigging Apparatus | Sep. 06, 1994 |
| 5,163,726 | Spreader Bar and Overheight Attachment with Automatic Latching Mechanism | Nov. 17, 1992 |
| 4,925,080 | Spreader Bar Apparatus | May 15, 1990 |
| 4,538,849 | Spreader Bar Assembly | Sep. 03, 1985 |
| 4,486,120 | Spreader Bar for Soil Erosion Prevention Mats | Sep. 04, 1984 |
| 4,397,493 | Spreader Bar Assembly | Aug. 09, 1983 |
| 4,352,516 | Spreader Bar | Oct. 05, 1982 |
| 4,324,023 | Ratchet Buckle Having Reinforcing Spreader Bar Insert | Apr. 13, 1982 |
| 4,248,472 | Bow and Spreader Bar | Feb. 03, 1981 |
| 4,188,168 | Bow and Spreader Bar | Feb. 12, 1980 |
| 3,972,501 | Spreader Bar Assembly for a Concrete Wall Form | Aug. 03, 1976 |

BRIEF SUMMARY OF THE INVENTION

The present invention provides an adjustable spreader bar arrangement of improved construction and configuration. The apparatus includes an elongated bar member to which a pair of sling receptive end pieces or fittings can be affixed. Each end piece or fitting preferably includes a sleeve that slides upon the bar member. Each end piece or fitting can be secured or locked in a selected position on the bar member.

Once an end piece or end fitting is lined up with a hole or bore in the bar member, a locking member can be inserted through the sleeve and the bar at the aligned openings/bores.

The design of the present invention provides for easy length adjustability, even for large capacities while optimizing spreader bar stresses.

The present invention thus provides an improved spreader bar apparatus. In one or more embodiments, the apparatus includes a bar member having a bar length, first and second bar end portions, a central longitudinal bar axis and a plurality of stops spaced between the bar and end portions.

Left and right end pieces or end fittings are preferably each movable along the bar into multiple, selectable locations. A lock or loading mechanism secures a selected end piece or end fitting to a selected position on the member bar. The distance between the end pieces can thus be varied to thus fit a particular load to be lifted.

Multiple lifting lines can be attached to each of the end pieces, fittings or trunions. Each end piece, end fitting or trunion has opposed, laterally extending load transfer projections to which slings can attach, such as by engaging the selected projection with a sling loop.

In one embodiment, a locking mechanism can be a pinned connection that preferably enables a connection of each end piece to a selected opening, location or stop along the bar member.

In one embodiment, a pinned connection preferably connects each end piece sleeve to the bar at a selected bar opening or stop.

In one embodiment, each end piece is preferably connectable to a lift line or to a sling or slings.

In one embodiment, the stops preferably include spaced apart bar openings.

In one embodiment, the bar can be a hollow pipe or tube and the stops are preferably pairs of aligned openings.

In one or more embodiments the present invention provides an improved spreader bar apparatus that provides a bar member having a bar length and first and second bar end portions. A plurality of transverse bar openings or transverse bores are spaced between the bar end portions.

A first or left end piece can be mounted on the bar and preferably movable relative to the bar.

A second or right bar end piece can be mounted on the bar and preferably movable relative to the bar.

Each bar lifting end piece can be movable from one bar opening to another bar opening.

One or more lifting lines can be attachable to each of the lifting portions, such as to upper and lower links.

The present invention includes a spreader bar apparatus, including a bar member having a bar length, first and second bar end portions, and a plurality of stops preferably spaced between said first and second bar end portions; a first movable fitting preferably slideably movable on the bar; a second movable fitting preferably slideably movable on the bar; each fitting preferably movable from one of the plurality of stops to another of the plurality of stops; each movable fitting including a pair of opposed, laterally extending projections, each projection having a load transfer surface that is configured to connect to a sling or lift line; multiple lifting lines or slings that can be attachable to the first and second fittings; and wherein each fitting includes a sleeve, wherein the sleeve has a bore that is receptive of the bar member; a lock that secures a fitting to the bar at a selected stop; the slings including a first sling that preferably attaches to the first fitting and extending above the bar and a second sling that preferably attaches to the first fitting and extending from the first fitting below the bar; and the slings including a first sling that preferably attaches to the second fitting and extending above the bar and a second sling that preferably attaches to the second fitting and extending from the second fitting below the bar.

In one embodiment, the fitting can have transverse openings that extend through the sleeve.

In one embodiment, the lock includes a pinned connection that preferably enables a connection of each sleeve to a selected stop.

In one embodiment, each stop can include one or more bar openings.

In one embodiment, each bar opening is preferably receptive of the locking pin.

In one embodiment, the lock can include a pinned connection that preferably connects each sleeve to the bar member at a selected stop and wherein the pinned connection preferably connects to the sleeve.

In one embodiment, each load transfer surface can be a part of a laterally extending member that preferably extends from a sleeve.

In one embodiment, a common pinned connection preferably joins a fitting and the sleeve in between the lateral members.

In one embodiment, the plurality of stops preferably includes spaced apart bar openings.

In one embodiment, the plurality of stops can be pairs of aligned openings.

The present invention includes a spreader bar apparatus, including a bar member having a bar length or bar central longitudinal axis, first and second bar end portions and a plurality of transverse bar openings spaced between the first and second bar end portions; a first bar lifting portion that can be slidably movable relative to the bar member; a second bar lifting portion that can be slidably movable relative to the bar member; each bar lifting portion being movable from one of the bar openings to another of the bar openings; each lifting portion preferably including a sleeve that slides upon the bar member and a pair of laterally extending load transfer members that are preferably attached to the sleeve and that extend in opposing directions from the central, longitudinal axis, each load transfer member preferably configured to attach to a sling or lift line; and one or more pins that preferably enable the sleeve to be attached to the bar member at a selected bar opening.

In one embodiment, each load transfer member can have a curved outer surface.

In one embodiment, the pin preferably defines a pinned connection that joins each sleeve to a selected opening.

In one embodiment, each load transfer member has a generally cylindrically shaped outer surface.

In one embodiment, an end plate is preferably attached to each load transfer member at a position spaced away from the sleeve.

In one embodiment, further comprising multiple lift lines that each preferably attach to a laterally extending load transfer member.

In one embodiment, one or more of the lift lines can be a sling.

In one embodiment, multiple lift lines can be a sling.

In one embodiment, each sling has two spaced apart loops, a loop preferably connecting to a laterally extending load transfer member.

In one embodiment, each sling has two spaced apart loops, a loop preferably connecting to a laterally extending load transfer member.

In one embodiment, the pinned connection preferably connects each sleeve to the bar at a selected opening and the pin extends to each load transfer member.

In one embodiment, each load transfer plate has a plate opening that is preferably in communication with the load transfer member bore.

In one embodiment, the pin preferably extends to each bore of the load transfer members in a loading position.

In one embodiment, the bar openings include a pair of horizontally aligned openings that are each preferably equidistant from a bar end portion.

In one embodiment, the bar openings can have pairs of aligned openings.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
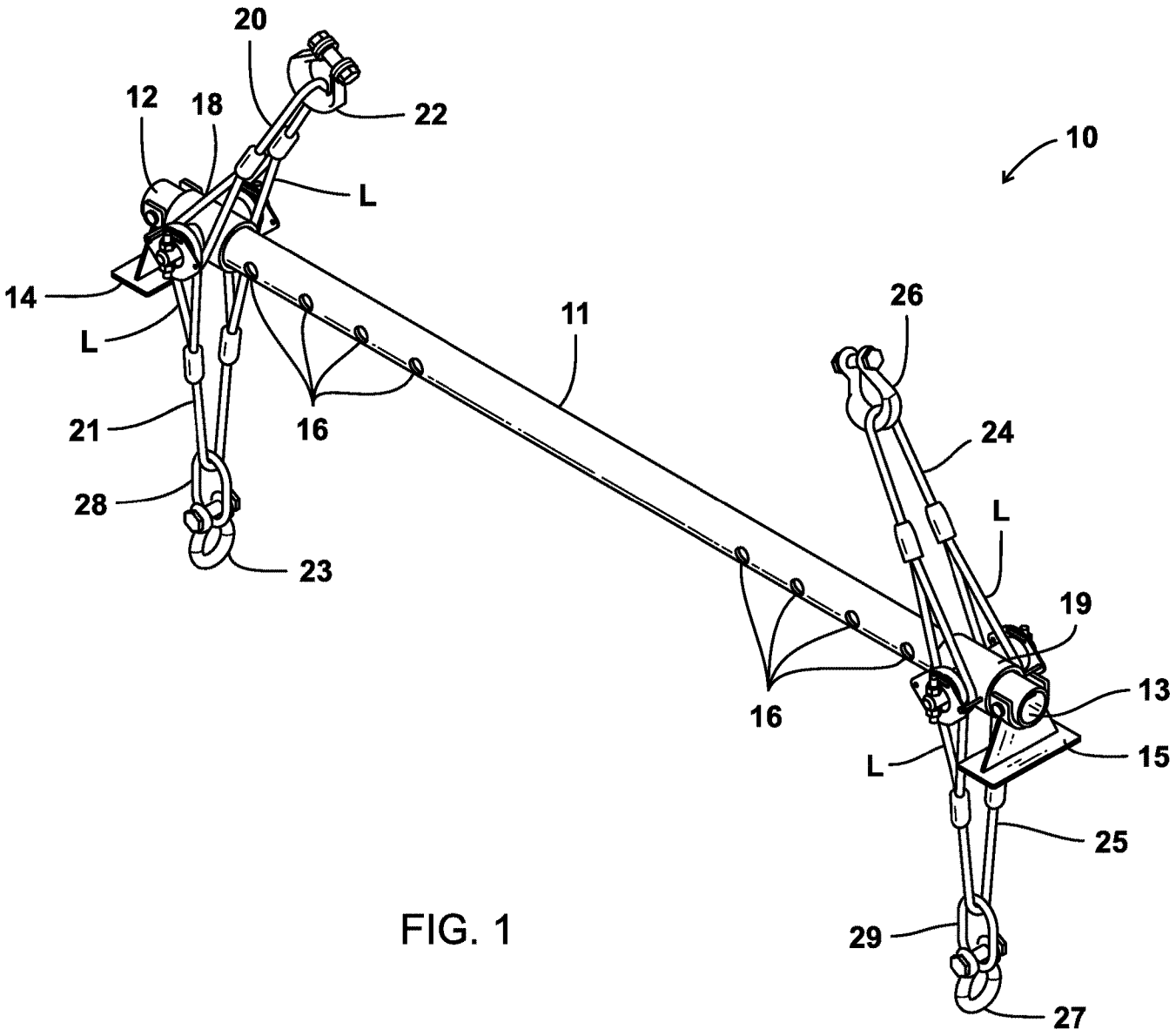
FIG. 1 is a perspective view of a preferred embodiment of the apparatus of the present invention.
Figure 2:
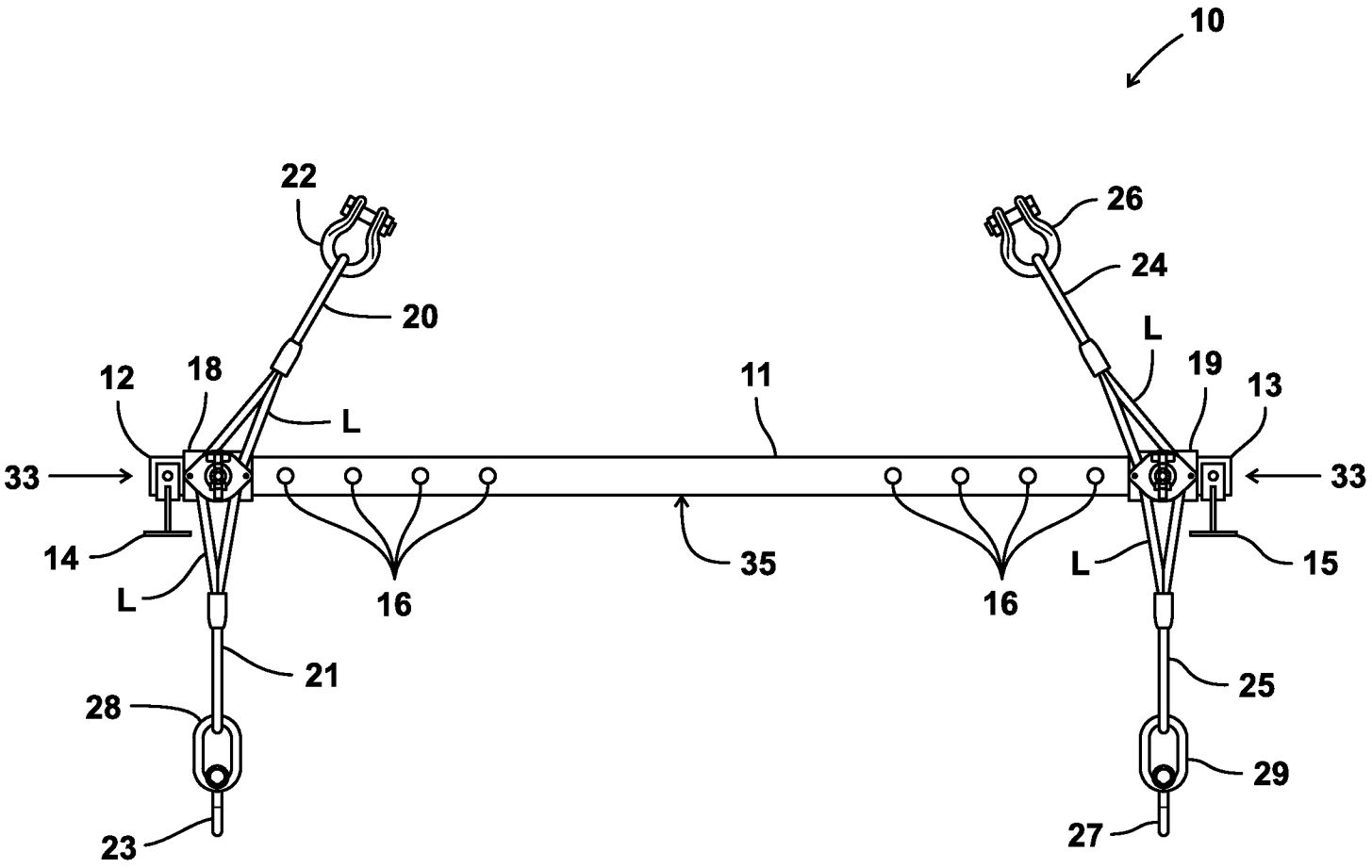
FIG. 2 is an elevation view of a preferred embodiment of the apparatus of the present invention.
Figure 3:
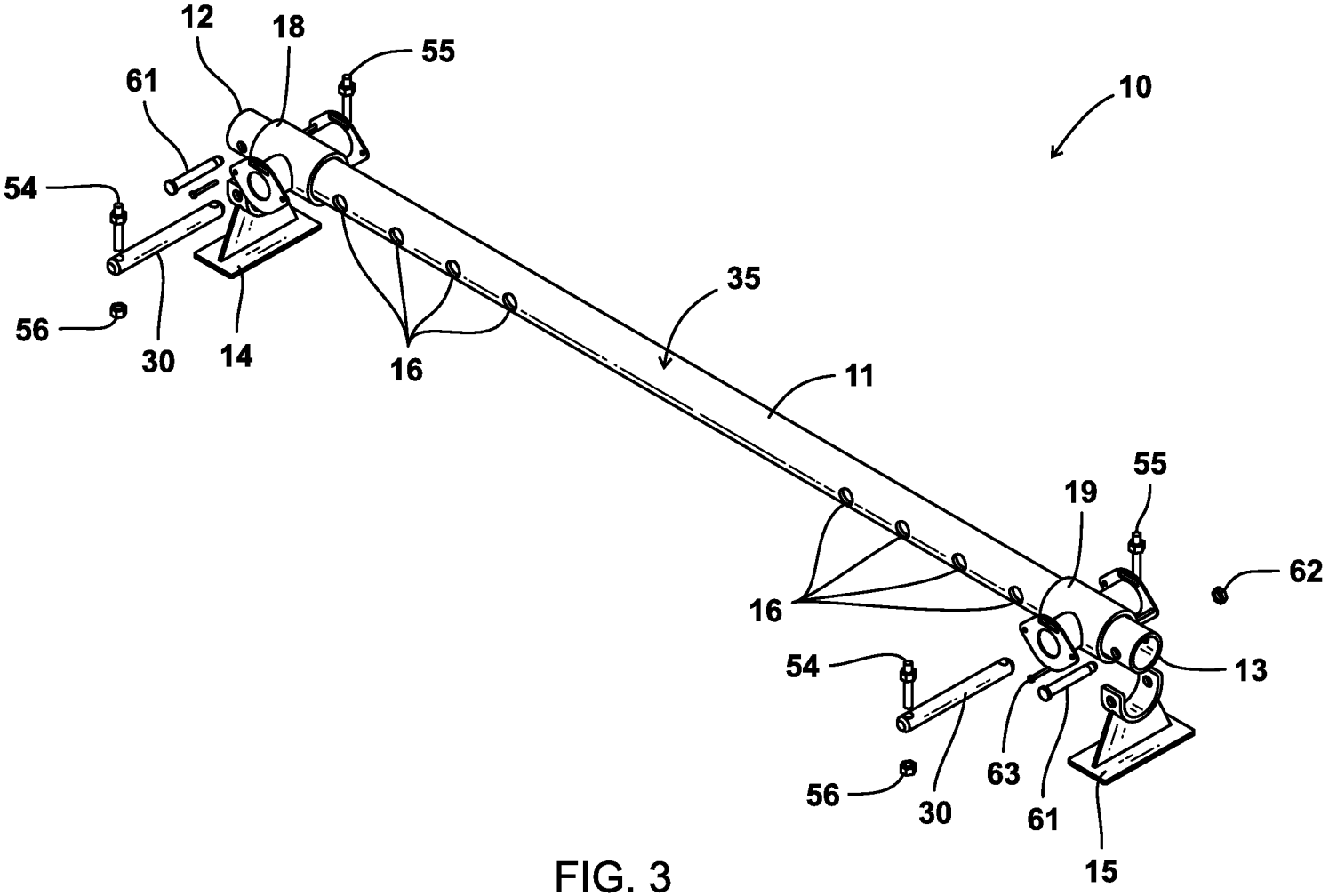
FIG. 3 is an exploded perspective view of a preferred embodiment of the apparatus of the present invention.
Figure 4:
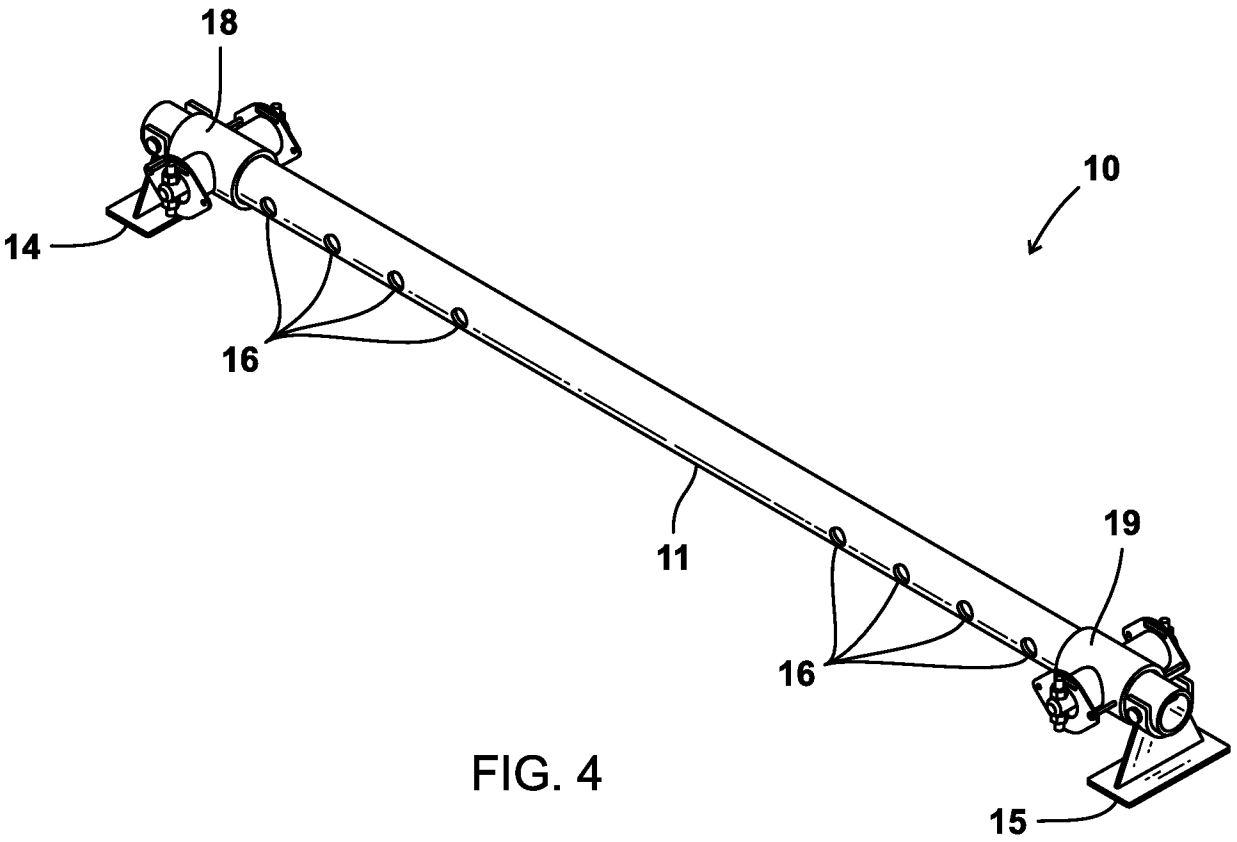
FIG. 4 is a perspective view of a preferred embodiment of the apparatus of the present invention with slings/lift lines removed for clarity.
Figure 5:
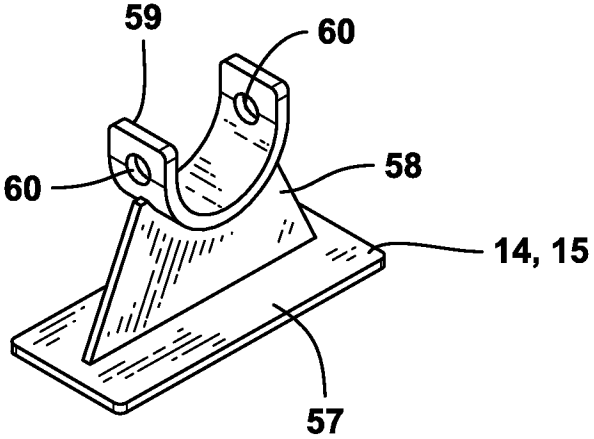
FIG. 5 is a fragmentary perspective view of a preferred embodiment of the apparatus of the present invention showing the support stand.
Figure 6:
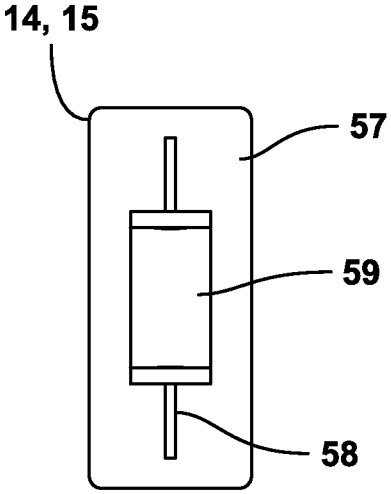
FIG. 6 is a fragmentary top view of a preferred embodiment of the apparatus of the present invention showing the support stand.
Figure 7:
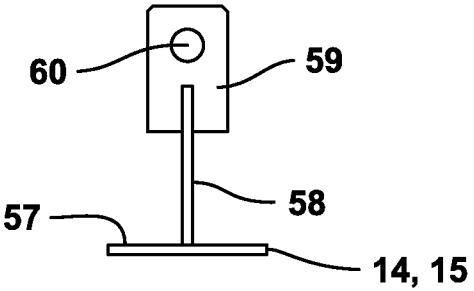
FIG. 7 is a fragmentary end view showing the support stand of FIGS. 5 and 6.

FIGS. 1-14 show a preferred embodiment of the apparatus of the present invention, designated generally by the numeral 10. Apparatus 10 can be manufactured of welded steel construction. Adjustable spreader bar apparatus 10 has two (2) spaced apart movable end pieces or end fittings 18, 19 that can be adjustably placed at selected positions along bar member 11. Bar member 11 has ends or end portions 12, 13.

End pieces, end fittings or trunions 18, 19 can be seen in more detail in FIGS. 10-13. A support 14, 15 can be used to support bar member 11 when the apparatus 10 rests upon an underlying surface such as a concrete slab, shop floor, gravel filled surface, construction yard or the like. Support or bar support 14 can support bar end or end portion 12. Support or bar support 15 can support bar end or end portion 13 as seen in FIGS. 1-4 and 8-9. Supports 14, 15 can be seen in more detail in FIGS. 5-7.

Stops are preferably provided along the length of bar member 11 so that a selected end piece, end fitting or trunion 18, 19 can be locked or affixed to bar member 11 at a selected locale. In this fashion, bar apparatus 10 can be adjusted to lift objects of differing dimensions. For a smaller object that is to be lifted, the end pieces, end fittings or trunions 18, 19 can be placed closer together on bar member 11. For a larger object that is to be lifted, the end pieces, end fittings or trunions 18, 19 can be placed farther apart on bar member 11.

Figure 8:
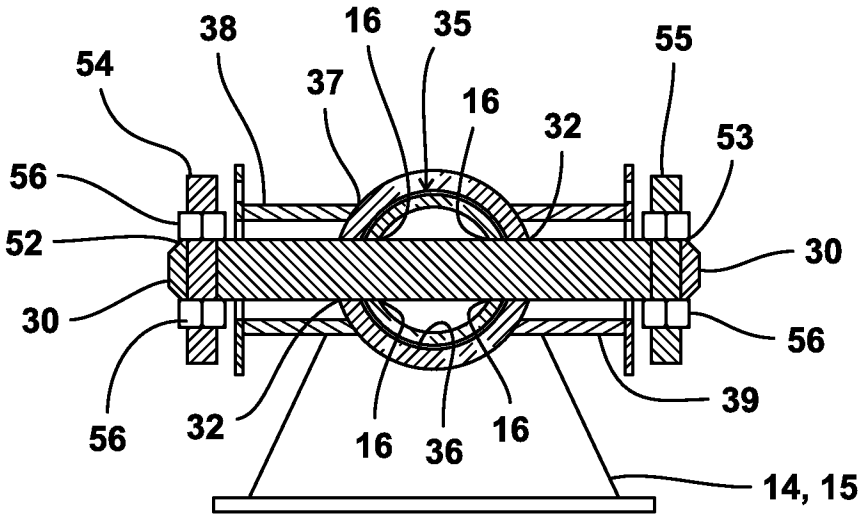
FIG. 8 is a transverse sectional view of a preferred embodiment of the apparatus of the present invention showing a locking position of the pin, end piece or end fitting and bar member.
Figure 9:
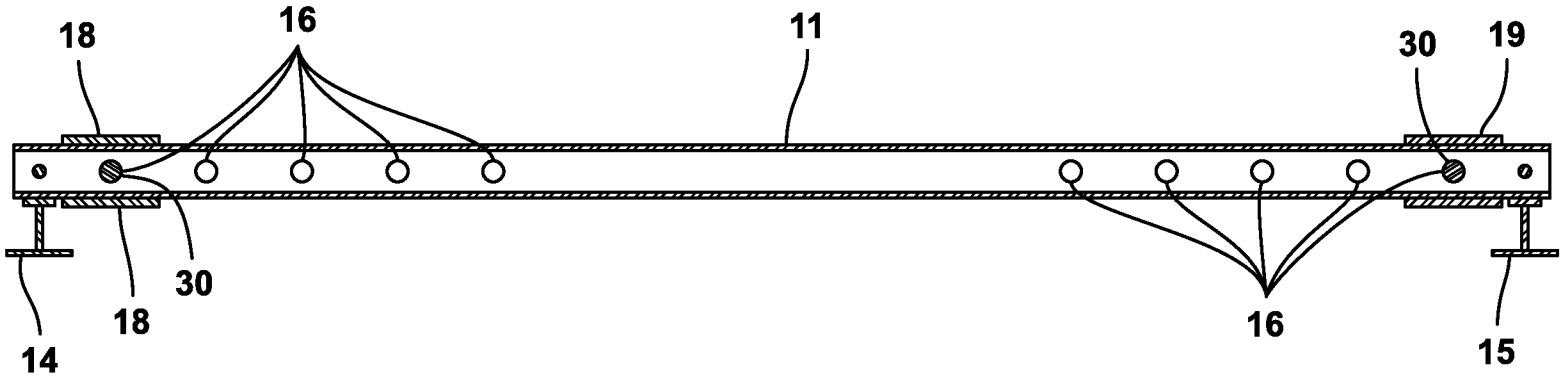
FIG. 9 is a longitudinal sectional perspective view showing an end piece or end fitting.
Figure 10:
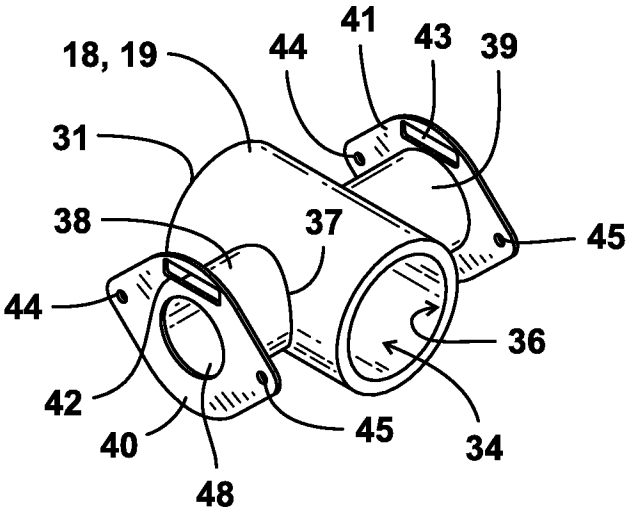
FIG. 10 is a fragmentary perspective view showing an end piece or end fitting or trunion.
Figure 11:
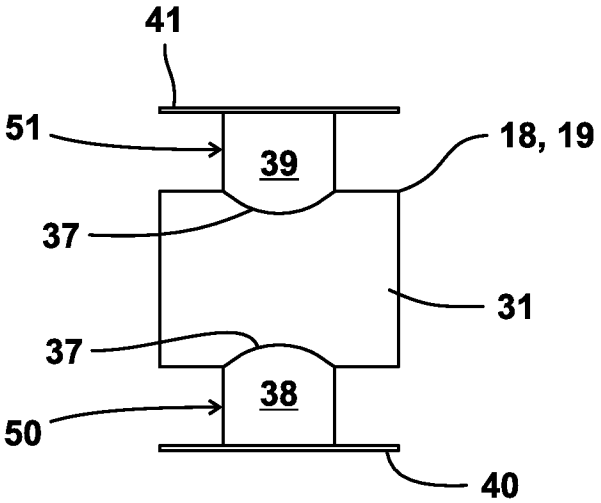
FIG. 11 is a fragmentary top view showing an end piece, end fitting or trunion.
Figure 13:
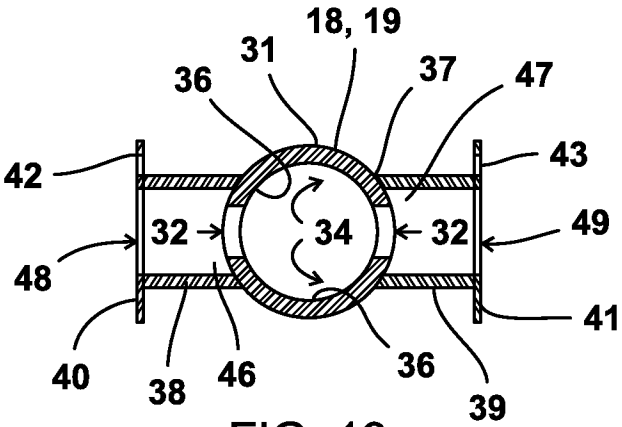
FIG. 13 is a sectional view showing an end piece, end fitting, or trunion.
Figure 12:
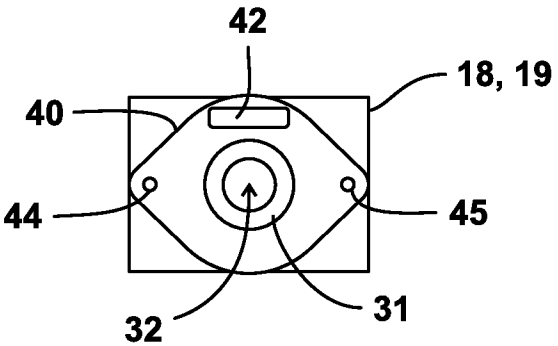
FIG. 12 is a fragmentary end view showing an end piece, end fitting, or trunion.
Figure 14:
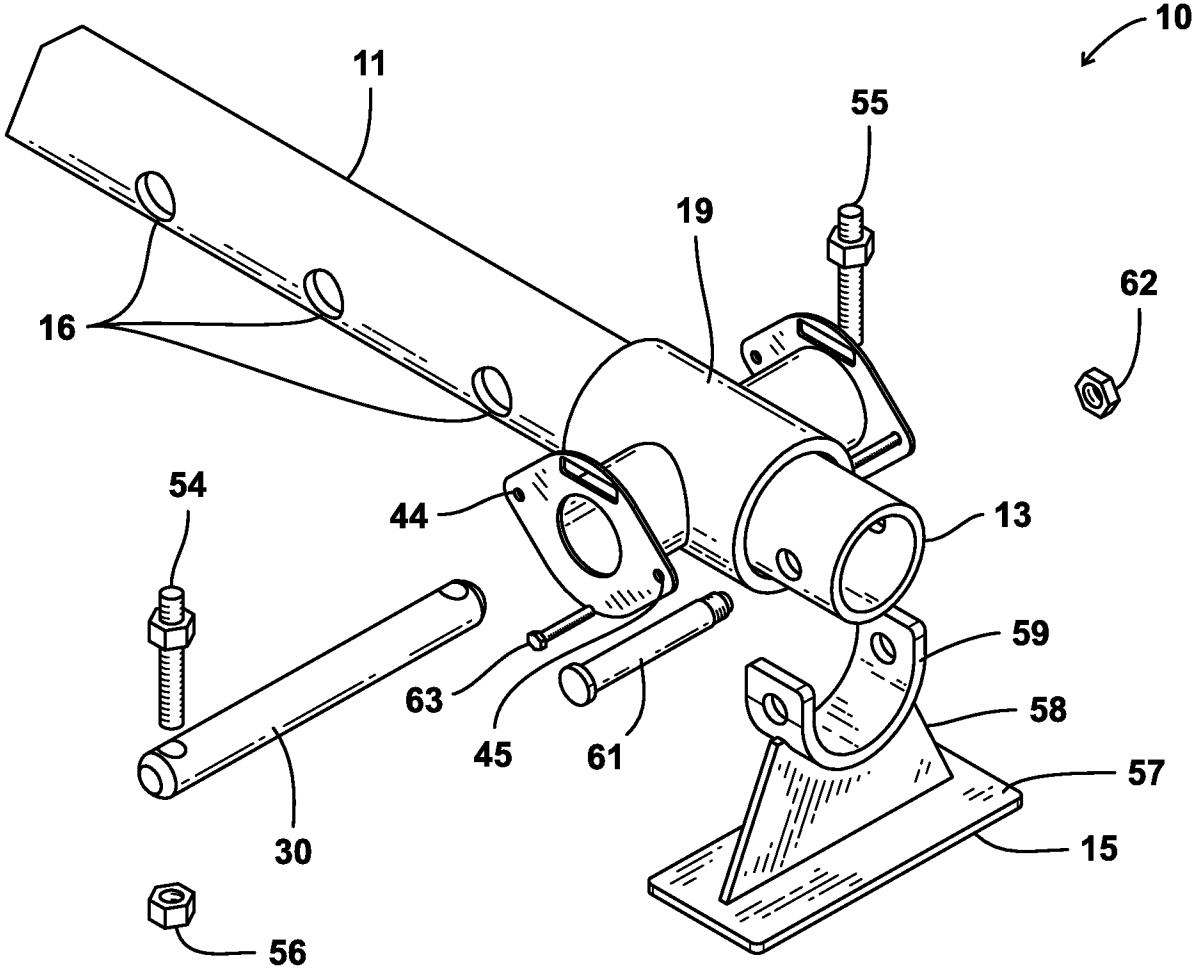
FIG. 14 is an exploded partial perspective view of a preferred embodiment of the apparatus of the present invention.

Each end piece, end fitting or trunion 18, 19 can be secured or locked to bar member 11 at a selected location. Locking can be achieved by using a locking pin or pinned connection 30. The locking pin or pinned connection 30 can utilize openings or transverse openings 16 in bar member 11 as well as openings 32 in sleeve 31 of end piece 18, 19. FIG. 8 shows locking pin or pinned connection 30 extending through opposed openings 16 in bar member 11 as well as through openings 32 in sleeve 31. In FIG. 14, bar member 11 can be a tubular or pipe with a hollow bore or central longitudinal bore 33. Alternatively, bar member 11 can be a solid bar not having a bore.

Sleeve 31 has a hollow bore 34 that is sized and shaped to receive bar member 11. For example, bar member 11 can be cylindrically shaped or tubular and wherein sleeve 31 bore 34 is preferably correspondingly cylindrically shaped. In this fashion, sleeve 31 preferably slides over but conforms closely to the outer surface 35 of bar member 11. Sleeve 31 has inside surface 36 that conforms closely to outer surface 35 so that sliding of sleeve 31 upon bar 11 is enabled.

Laterally extending sleeves 38, 39 are connected to sleeve 31 at welds 37 (see FIGS. 10-13). Each laterally extending sleeve 38, 39 has an end plate 40, 41 opposite welds 37 as seen in FIGS. 10-13. End plate 40 is connected to laterally extending sleeve 38 (e.g., weld connection). End plate 41 is connected to laterally extending sleeve 39 (e.g., weld connection). Each end plate 40, 41 has a large plate opening 48, 49 and a pair of smaller plate openings 44, 45. Plate 40 has larger plate opening 48. Plate 41 has larger plate opening 49. Each laterally extending sleeve 38, 39 has a sleeve bore 46, 47 respectively (see FIGS. 8 and 13). The sleeve bores 46, 47 and larger plate openings 48, 49 enable access for placing pin or pinned connection 30 into aligned openings 16, 32 when affixing a selected end piece, end fitting or trunion 18, 19 to bar member 11 at a selected opening 16 (e.g., see FIG. 8).

Each end plate 40, 41 can provide a slot 42, 43 (see FIGS. 10 and 12) for enabling handling by a user such as when end piece 18, 19 must be moved to a different position on bar member 11. Openings 44, 45 are smaller plate openings that can be fitted with keeper bolt and nut 63, or tugger lines.

Each laterally extending sleeve 38, 39 preferably provides an outer surface 50, 51 that is a load transfer surface for transfer of load to slings 20, 21 or 24, 25. In FIG. 1, slings 20 and 21 are slings that attach to end fitting, end piece or trunion 18. In FIG. 1, slings 24 and 25 are slings that attach to end piece, end fitting or trunion 19. Slings 21 and 25 are downwardly extending slings that can be attached to an object to be lifted using shackles 23, 27 and rings 28, 29 or other rigging. Slings 20, 24 are upwardly extending slings that can be attached to lift lines of a crane or other lifting device or to rigging that attaches to the crane or lift device lift line(s). Slings 20, 24 can be fitted with shackles 22, 26 or other rigging to provide a load transfer interface between slings 20, 24 and a crane or other lifting device. Each sling 20, 21, 24, 25 can have a pair of end loops L. Loops L preferably enable easy connection or rigging of a sling 20, 21, 24, 25 to a selected end fitting 18, 19 at a selected laterally extending sleeve 38, 39 as seen in FIGS. 1-3 and 10-13. Slings 20, 21, 24, 25 having pairs of loops L are commercially available. In FIGS. 1-3 and 10-13, each sling loop L preferably attaches to a laterally extending sleeve 38, 39 of a selected end fitting 18, 19 at a position in between weld 37 and an end plate 40 or 41.

In FIG. 8, locking pin 30 can be provided with pin openings at 52, 53. Each pin opening 52, 53 can be fitted with a fastener 54, 55 so that pin 30 cannot be dislodged during a lift. Fasteners 54, 55 can be bolts or all threaded rods fitted with nuts 56. In FIG. 8, fastener 54 occupies pin opening 52. Fastener 55 occupies pin opening 53.

In FIGS. 1, 5-7 and 14, each bar support 14, 15 can include base plate 57, vertical plate 58 and a generally U-shaped cradle 59. Parts 57, 58, 59 can be welded together. Cradle 59 is sized and shaped to conform to the shape of outer surface 35 of bar member 11. Each bar support 14, 15 can be secured to a provided transverse opening or openings in bar member 11 with a bolted connection (e.g., bolt 61 and nut 62) that passes through provided cradle openings 60 (see FIGS. 1, 5-7 and 14).

Keeper bolts/nuts 63 can be connected to end plates at smaller openings 44, 45. These keeper nut and bolt arrangements prevent disengagement of a sling 20, 21 and 24, 25 from an end piece 18, 19.

The following is a list of parts and materials suitable for use in the present invention:

| PARTS LIST: | |
|---|---|
| PART NUMBER | DESCRIPTION |
| 10 | adjustable spreader bar apparatus |
| 11 | bar member/bar/pipe |
| 12 | bar end/bar end portion |
| 13 | bar end/bar end portion |
| 14 | support/bar support |
| 15 | support/bar support |
| 16 | bar opening/transverse opening |
| 18 | end piece/fitting/trunion |
| 19 | end piece/fitting/trunion |
| 20 | sling |
| 21 | sling |
| 22 | shackle |
| 23 | shackle |
| 24 | sling |
| 25 | sling |
| 26 | shackle |
| 27 | shackle |
| 28 | ring |
| 29 | ring |
| 30 | locking pin |
| 31 | sleeve |
| 32 | opening |
| 33 | hollow bore/bar central longitudinal bore |
| 34 | sleeve bore |
| 35 | outer surface |
| 36 | inner surface |
| 37 | weld |
| 38 | laterally extending sleeve |
| 39 | laterally extending sleeve |
| 40 | end plate |
| 41 | end plate |
| 42 | slot |
| 43 | slot |
| 44 | plate small opening |
| 45 | plate small opening |
| 46 | sleeve bore |
| 47 | sleeve bore |
| 48 | plate large opening |
| 49 | plate large opening |
| 50 | load transfer surface |
| 51 | load transfer surface |
| 52 | pin opening |
| 53 | pin opening |
| 54 | fastener |
| 55 | fastener |
| 56 | nut |
| 57 | base plate |
| 58 | vertical plate |
| 59 | cradle |
| 60 | cradle opening |
| 61 | bolt |
| 62 | nut |
| 63 | keeper bolt and nut |
| L | loop |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A spreader bar apparatus, comprising:

a) a bar member having a bar length, first and second bar end portions, and a plurality of stops spaced between said first and second bar end portions;

b) a first movable fitting movable on said bar member;

c) a second movable fitting movable on said bar member;

d) each fitting movable from a selected one of said plurality of stops to another selected one of said plurality of stops;

e) each said movable fitting including first and second opposed, laterally extending projections, each said projection having a load transfer surface that is configured to connect to a sling or a lift line;

f) multiple lifting lines or slings that are attachable to the first and second fittings, each said line or sling having a pair of end portions, each end portion having a loop;

g) wherein each said fitting includes a sleeve, wherein the sleeve has a bore that is receptive of the bar member;

h) locks that secure each said fitting to the bar member at a selected stop;

i) said lines or slings including a first line or sling that attaches to the first fitting by connecting the said loops to the projection load transfer surfaces and extending above the bar member and a second line or sling that attaches to the first fitting by connecting the said loops to the projection load transfer surfaces and extending from the first fitting below the bar member;

j) said lines or slings including a third line or sling that attaches to the second fitting by connecting the loops to the projection load transfer surfaces and extending above the bar member and a fourth line or sling that attaches to the second fitting by connecting the loops to the projection load transfer surfaces and extending from the second fitting below the bar member;

k) wherein each said loop attaches to a said load transfer surface; and l) wherein the said loops of each said line or sling connect to said first and second projections at a said load transfer surface.

2. The spreader bar apparatus of claim 1 wherein one or both of said movable fittings has transverse openings that extend through said sleeve.

3. The spreader bar apparatus of claim 1 wherein the lock includes a pinned connection that enables a connection of each sleeve to a selected stop.

4. The spreader bar apparatus of claim 3 wherein each said stop includes one or more bar openings.

5. The spreader bar apparatus of claim 4 wherein each bar opening is receptive of said lock wherein said pinned connection includes a pin that occupies a said bar opening.

6. The spreader bar apparatus of claim 3 wherein the pinned connection included a pin that joins each sleeve to a selected bar opening.

7. The spreader bar apparatus of claim 6 wherein the pinned connection connects each sleeve to the bar member at a selected opening and the pin extends to each projection.

8. The spreader bar apparatus of claim 1 wherein the lock includes a pinned connection that connects each sleeve to the bar member at a selected stop and wherein the pinned connection connects to the sleeve.

9. The spreader bar apparatus of claim 1 wherein each load transfer surface is a part of a laterally extending member that is connected to and that extends laterally away from a said sleeve.

10. The spreader bar apparatus of claim 9 wherein the lock includes a pinned connection that connects to a fitting and said sleeve in between said laterally extending members.

11. The spreader bar apparatus of claim 1 wherein the plurality of stops include spaced apart bar openings.

12. The spreader bar apparatus of claim 11 wherein the plurality of stops are pairs of aligned openings.

13. The spreader bar apparatus of claim 11 wherein the bar openings include a pair of horizontally aligned openings that are each equidistant from a said bar end portion.

14. The spreader bar apparatus of claim 11 wherein the bar openings are pairs of aligned openings.

15. The spreader bar apparatus of claim 1 wherein each load transfer surface is a curved outer surface.

16. The spreader bar apparatus of claim 1 wherein each said load transfer surface is a generally cylindrically shaped surface.

17. The spreader bar apparatus of claim 1 wherein each projection has an end plate attached thereto at a position spaced away from said sleeve.

18. The spreader bar apparatus of claim 17 wherein each said projection has a bore and wherein each said end plate has a plate opening that is in communication with a said projection bore.

19. The spreader bar apparatus of claim 18 further comprising one or more pins, wherein each said pin extends to each said bore of said projection in a loading position.

* * * * *